US005081935A

United States Patent [19]

Pavlick

[11] Patent Number: 5,081,935

[45] Date of Patent: Jan. 21, 1992

[54] RAILROAD CAR VERTICAL ISOLATOR PAD

[75] Inventor: Michael J. Pavlick, Blue Bell, Pa.

[73] Assignee: Transit America, Inc., Philadelphia, Pa.

[21] Appl. No.: 506,248

[22] Filed: Apr. 9, 1990

[51] Int. Cl.[5] ..... B61F 5/30

[52] U.S. Cl. ..... 105/224.1; 105/218.1

[58] Field of Search ..... 105/218.1, 218.2, 219, 105/220, 224.05, 224.06, 224.1, 225; 267/153, 292, 141; 248/633, 632, 634, 630

[56] References Cited

U.S. PATENT DOCUMENTS

| | | | |
|---|---|---|---|
| 2,100,065 | 11/1937 | Buckwalter | 105/224.1 |
| 3,638,582 | 2/1972 | Beebe | 105/218.1 |
| 4,363,278 | 12/1982 | Mulcahy | 105/218.1 |
| 4,413,569 | 11/1983 | Mulcahy | 105/224.1 |
| 4,433,629 | 12/1984 | Roush | 105/225 |
| 4,830,347 | 5/1989 | Langshaw | 267/141 |
| 4,928,339 | 5/1990 | Klawe | 248/633 |

FOREIGN PATENT DOCUMENTS

| | | | |
|---|---|---|---|
| 0975221 | 9/1975 | Canada | 105/224.1 |

*Primary Examiner*—Robert J. Oberleitner
*Assistant Examiner*—Mark T. Le
*Attorney, Agent, or Firm*—Walter B. Udell

[57] ABSTRACT

An elastomeric vertical isolator pad for placement between the roller bearing adaptors of railroad cars and the car truck sideframes, the pad being formed of an elastomer having a melting point not lower than 500° Fahrenheit and having a Shore hardness durometer in the range of 50 to 70, the pad being configured to have a base and lower sidewall portions which fit snugly within a pocket on the top of the bearing adaptor, and having upper sidewalls portions extending upward beyond the upper surface of the bearing adaptor to a pad upper surface configured for surface engagement with an overlying part of the truck sideframe, the upper sidewall portions being angled inwardly to the pad upper surface.

17 Claims, 4 Drawing Sheets

FIG. 1
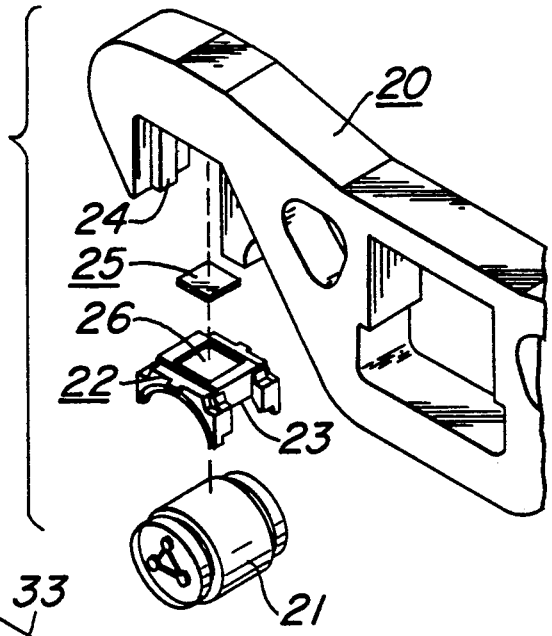
FIG. 3
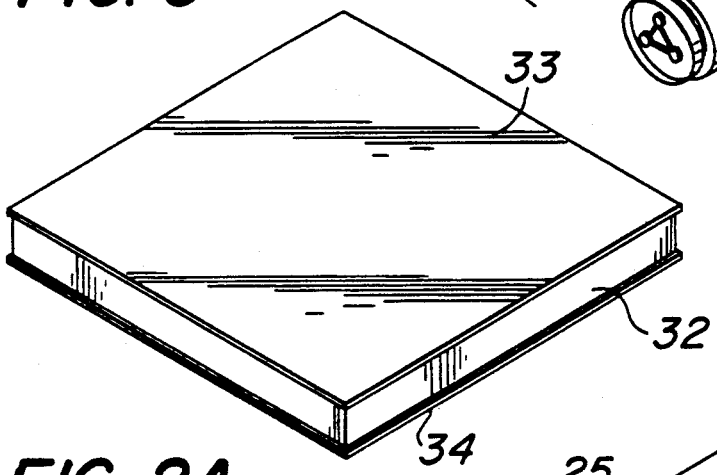
FIG. 2
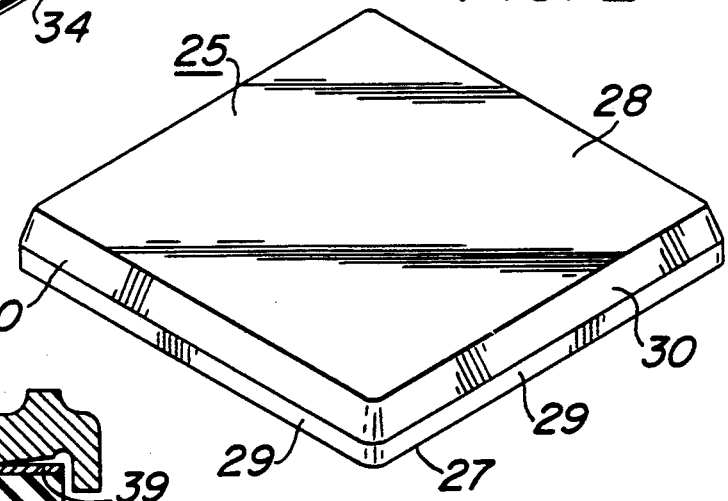
FIG. 2A
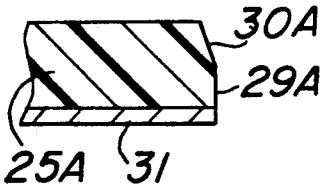
PRIOR ART
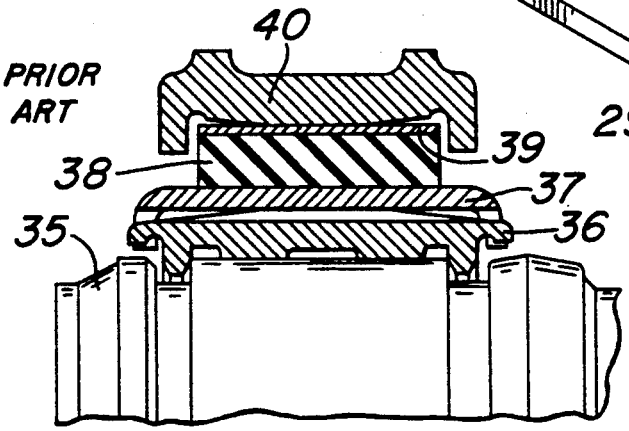
FIG. 4

LATERAL WHEEL FORCE VS. SPEED ON 7-1/2° CURVE INSTRUMENTED BALLOON LOOP TRACK

LATERAL WHEEL FORCE VS. SPEED ON 7-1/2° CURVE BALLOON LOOP TRACK INSTRUMENTED WHEEL SETS

HERTZIAN CONTACT STRESSES FOR 100 TON AND 125 TON AXEL LOADINGS VS. SPEED

RAILROAD CAR VERTICAL ISOLATOR PAD

BACKGROUND OF THE INVENTION

This invention relates generally to railroad car suspension systems, and more particularly relates to a novel isolator pad placed between each of the railroad car axle roller bearing adaptors and the car truck sideframes, which effectively decrease the unsprung mass of the car and make it possible to increase the payload of the car without causing an increase in damage to rails and roadbed.

Intermodal wellcars for carrying containers have in the past used 100 ton trucks having 36" wheels. Each such car has a total load capacity of 131,500 lbs. which when reduced by the weight of the car itself provides carrying capacity for containers of approximately 100,000 lbs. Containers are usually on the order of 45 feet long and are carried with one container in the well and the second container stacked above it. The containers, on average, weigh between 50,000 and 60,000 lbs. each. Accordingly, in order to double stack containers, even 50,000 lb. containers constitute a marginal load when double stacked in a wellcar, and it is not possible to stack two 60,000 or a 50,000 and a 60,000 lb. container in a wellcar without overloading the trucks.

There is, however, available for use, a truck which is designated as a 125 ton truck and has 38" wheels. A wellcar using a pair of trucks of this type has a load carrying capacity of 157,500 lbs. which when reduced by the weight of car itself leaves a load carrying capability of approximately 125,000 lbs. This allows for double stacking of perhaps 99% of all containers in use today. The problem with the 125 ton trucks is that the railroads have not wanted to use them because they produce excessive track and roadbed damage as compared to the 100 ton truck. Therefore, if it is possible to build a 125 ton truck which has dynamic characteristics on the rail and roadbed which are approximately those of the 100 ton truck, the load carrying capability of the wellcar can be materially increased without producing the adverse effects on the rails and roadbed, and accordingly would be acceptable by the railroad industry.

The prior patented art includes U.S. Pat. 3,381,629 to Walter B. Jones entitled "Cushion Mounted Bearing Adaptor For Railway Trucks" which discloses a pad used in the same location but for a different purpose, namely, as set forth in the Jones specification (column 1) "a resilient element over each bearing assembly which serves to accommodate lateral movements between the bearing assemblies and the truck frames to reduce and substantially eliminate lateral shocks to the side frames resulting from "hunting" of the wheels."

As will be subsequently described in connection with FIG. 4 of the drawings, labeled "PRIOR ART", Jones' device consists of a resilient pad sandwiched between and bonded to an upper steel plate and a lower steel plate, the resilient pad being specified as "rubber or synthetic rubber or any suitable plastic material". Rubber and synthetic rubber can not be so used because in use they are extruded outward from between the steel plates and quickly become ineffective. It is known that Jones type pads utilizing rubber have been tried in the past, in 100 ton truck cars, and have failed after very short use with cars which were substantially underloaded. The use of such devices was abandoned by the railroads before the advent of the intermodal double stack wellcars.

Because of the pressing nature of the need to increase the load carrying capacity of wellcars to handle double stacked 60,000 lbs. containers, and thereby substantially increase the economies of rail transportation, the feasibility of using 125 ton trucks was reconsidered. The accelerated rail wear problems and roadbed damage considerations normally associated with the use of such trucks precluded acceptance of such use unless someway could be devised to prevent such consequences. Accordingly, a vertical isolator pad was developed of the type to be subsequently described in connection with FIG. 3, consisting of a polyether based urethane elastomer pad having steel facing sheets bonded to the upper and lower surfaces. These isolator pads were extensively tested at the American Association of Railroads Transportation Test Center in Pueblo, Colo. with instrumented track and instrumented wheel sets on several different kinds of track situations. The results of these tests are shown in FIGS. 5 through 11 to be subsequently described.

In summary, these tests indicated that the articulated geometry and the primary suspension system of the vertical isolator pads in the 125 ton articulated wellcars are effective to reduce both vertical and lateral dynamic forces to magnitudes that do not exceed comparable car forces generated by 100 ton cars. In many cases the articulated wellcars produced much lower forces than the 100 ton equipment, showing that the vertical isolator pad does, in fact, reduce dynamic forces on 125 ton four wheel trucks. Since these lower forces lower rail contact and rail bending stresses, the vertical isolator pad, in combination with articulated cars, permits the use of higher axle capacities without adversely affecting rail or support structures.

The only remaining question was how the pads would perform under actual operating conditions in normal railroad service. To determine this, a number of cars were fitted with the vertical isolator pads and put into service in various parts of the country to experience varying weather and environmental conditions, and data was accumulated. After these pads were in experimental use for approximately a year to fifteen months failures began to appear. One type of failure was the separation of the steel face plate from the elastomer pad. The second type of failure was a compressive failure of the elastomer, which appeared as a flattening and a partial extrusion of the elastomer out from between the steel plates. This resulted in substantial degradation of the resilient performance of the pad. The degradation was such that ultimately the pad had no impact reducing effect whatever. A third adverse consequence occurred when the pads had been degraded, which was the creeping of the pad structure up out of the pocket on the roller bearing adapter, which led to uneven loading on the roller bearing and ultimate failure of the bearing.

Extensive testing was then undertaken to attempt to determine why these pads were failing. The compressive failure problem was laboratory tested by subjecting the pads to compressive forces substantially three times their normal operating load of 38,000 pounds, or 114,000 pounds loading on the pad. These tests showed no evidence whatever of compressive failure, and no permanent set of the pad when the vertical loading was released. The failed pads were reexamined, and it appeared that there was some evidence that the elastomer had been subjected to excessively high temperatures, much higher than would be encountered by being used in hot environments. The normal temperatures encountered by the pad in its environment would be on the order of 150° Fahrenheit just due to heat generated by the bearing. The type of heat condition that was evidence by the failed pads was far in excess of 150°, and such pad failures occurred even When the bearings were in perfectly proper operating condition. The pads were then heated in ovens to 150° and some to 200° Fahrenheit and then the static three times compressive load test was repeated. In no case was there any pad failure. The problem was still not understood and yet other compressive test runs in which the vertical loading forces were raised to 400,000 pounds per pad under static conditions at room temperature did not produce pad failure. A dynamic test was performed in which the pad was subjected to a compressive cyclicly changing loading. The initial loading was set at 38,000 pounds, the normal loading for the pad, and the pad was then subjected compressively to a triangular waveform which increased to 68,000 pounds and then reduced to 38,000 pounds continuously at a four Hertz rate. This was done to determine whether the variation in loading which produced some flexing of the pad could in fact generate internal heat, and was a conservative test in that it overstressed the pad, because actual in-use testing determined that the cyclic rate applied to the pads in actual use is on the order of two Hertz. Additionally, the 68,000 pounds peak load was selected on the basis of being the maximum impulse load that the pad would be subjected to in actual use. The tests were run on each pad for at least one million cycles, and it was determined that the internal temperature rise in the pad was not in excess of 20° Fahrenheit. The pads tested showed no evidence of failure whatever. The one million cycle test was considered to represent between two and three years of actual service in the field.

It subsequently became known that the temperature data supplied by the railroads was in error in that it had been indicated that the railroads overheated bearing detectors would be actuated at 200° Fahrenheit. In fact, the 200° Fahrenheit temperature was not actual temperature, but 200° Fahrenheit above ambient. The ambient temperature in a desert summer condition could itself be at 120°, thus giving a detected actual temperature of 320° Fahrenheit. None of the testing had been done at these temperatures, so that all of the previous data based upon temperature had to be reconsidered. The previous tests were then duplicated at 250° Fahrenheit, 300° Fahrenheit and 350° Fahrenheit and showed some rather different results from the previous tests. At 250° Fahrenheit the pads performed well. At 300° Fahrenheit there began to be some evidence of the pads starting to take a set. At 350° Fahrenheit the set became much more pronounced, and it was considered that in actual service this condition would lead to a pad failure. This was the first indication that a high temperature elastomer was required.

One additional observation of the pads became highly significant, namely, that scoring was observed on the outer surfaces of the steel plates, indicating that relative motion had taken place laterally between the pad and the surfaces of the wheel bearing adapter. This suggested that additional heat might have been generated by the frictional engagement, and that the high heat build up in the steel plates due to this frictional engagement eventually caused the separation of the plates from the elastomer pad. Since the elastomer has a melting point in the 500° Fahrenheit range it became evident that the elastomer at the inner face with the steel plate had been subjected to temperatures in that range in order to cause separation. This significant information led to the consideration of several modifications to the vertical isolator pad.

The first change was to make a pad without the steel plates so that there would not be the heat sink effect of the steel plates reaching a high temperature and creating failure of the bond. Additionally, in order to eliminate scoring motion that had appeared on the steel plates the dimensions of the pad were increased so that it fit snugly in the pocket of the bearing adaptor, and accordingly could not shift laterally within the pocket. Also, because of the determination of the temperatures which could be achieved at the surfaces of the pad it was necessary to utilize a higher temperature elastomer which would have a melting range somewhere between 550° and 650° Fahrenheit. It was also observed that once the steel plates came loose from the elastomer pads, the movement of the plates relative to the pad would chew up the entire surface of the elastomer, and ultimately the plates destroyed the pad. This information flew directly in the face of a specification that had been set by the railroads, which was that unless the pads had steel faces so that there would be a steel to steel contact in the use environment, the railroad industry would not consider using such a pad. Accordingly, it was a requirement set by the railroads which unknowingly was a key factor in the failure of the pads.

From the foregoing information, a new vertical isolator pad according to the invention was conceived, of the configuration shown in FIG. 2, and to be subsequently described. The material selected has a Shore hardness durometer of about 65 and is marketing by Air products and Chemicals, Inc. under its trademark polathane XPE System-30 High-performance Urethane. The pad was made thicker so that the height of the elastomer was equal to the height of the composite original pad, which had been elastomer plus two sheets of steel facing. The bottom portion of the pad was molded of rectangular cross section so that it would fit exactly within the pocket, and the portion of the pad that extended above the surface of the pocket edges was tapered inwardly so that it formed a trapezoidal cross section. This tapering is necessary because under load conditions the portion of the pad not retained within the pocket tends to bulge laterally, and bulging with straight pad sidewalls could exert vertical forces tending to cause the pad to migrate out of the pocket, which would cause failures similar to those previously encountered due to unequal loading of the bearing adapter. The newly devised pad was retested at 250°, 300° and 350° Fahrenheit under the three times static load of 114,000 pounds. The results showed that the pads did not take any permanent set under any of these conditions, indicating that these pads were far more temperature resistent than the previous pads and would not be subject to failures of the kind encountered during the use tests. The pads according to the invention were also dynamically tested, as Will be subsequently described in connection with FIGS. 5, 6 and 14, with the result that the useful life of these pads is projected at one million miles of railroad car service corresponding to substantially three to five years of actual car usage, and meeting the requirements of the railroad industry.

SUMMARY OF THE INVENTION

The invention contemplates a monolithic elastomeric pad for placement between the roller bearing adaptors of railroad cars and the car truck sideframes, the pad being configured to have a base and lower sidewall portions which fit snugly within a pocket on the top of the bearing adaptor, and having upper sidewalls portions extending upward beyond the upper surface of the bearing adaptor to an upper pad surface configured for surface engagement with an overlying part of the truck sideframe, the upper sidewall portions being angled inwardly to the upper pad surface.

It is a primary object of the invention to provide a railroad car vertical isolator pad as aforedescribed.

Another object of the invention is to provide a railroad car vertical isolator pad as aforesaid which is formed of an elastomer material having a melting point not lower than 500° Fahrenheit.

A further object of the invention is to provide a railroad car vertical isolator pad as aforesaid which is formed of an elastomer material having a Shore durometer in the range of 50 to 70.

Still another object of the invention is to provide a railroad car vertical isolator pad as aforesaid together with a bearing adaptor, such that the isolator pad and bearing adaptor are configured to snugly interfit with one another and provide pad upper and lower surfaces of sufficient area to maintain the pressure per square inch exerted on the pad in use within the capabilities of the pad material.

The foregoing and other objects of the invention will be clear from a reading of the following description in conjunction with an examination of the drawings, wherein:

BRIEF DESCRIPTION OF THE DRAWINGS

FIG. 1 is an exploded perspective view of a portion of a railroad car truck assembly, showing the axle bearing, bearing adaptor, vertical isolator pad and truck sideframe;

FIG. 2 is an isometric view of a vertical isolator pad according to the invention;

FIG. 2A is a partial vertical sectional view through one end of a modified form of the pad shown in FIG. 2 having a steel plate bonded to the bottom surface of the elastomer pad;

FIG. 3 is an isometric view of an early vertical isolator pad which performed well under initial testing but which failed in actual use;

FIG. 4 is a vertical sectional view of an inoperative prior art device;

DESCRIPTION OF PREFERRED EMBODIMENTS AND PRIOR ART

Figure 5:
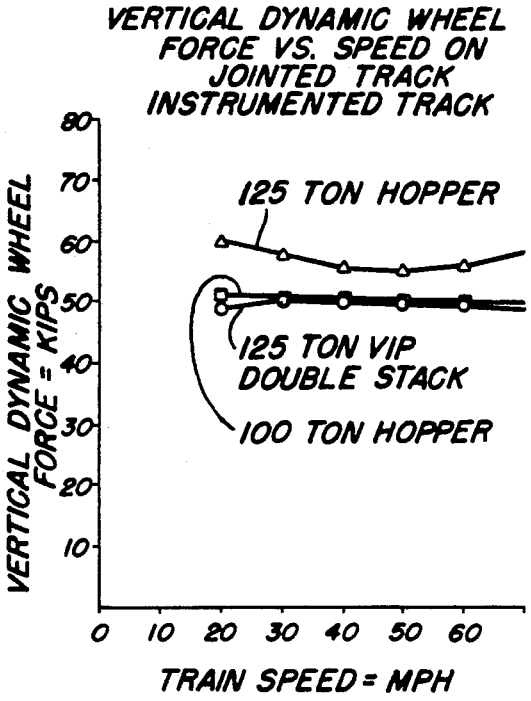
FIGS. 5 through 11 are graphs of comparative test data obtained for the pad of FIG. 2.

Considering now the drawings, and firstly the showing of FIG. 1, there is seen a railroad car truck sideframe designated generally as 20, formed at each end with a recess into which upwardly fits an axle bearing 21 surmounted by a bearing adaptor 22 having keyways 23 at opposite longitudinal ends thereof which interfit with sideframe keys 24, and having a vertical isolator pad 25 seated within a pocket 26 in the upper face of the bearing adaptor 22. The preferred embodiment of the vertical isolator pad 25 according to the invention is seen in FIG. 2 and is observed to be of generally square or rectangular shape having a bottom surface 27, an upper surface 28, lower vertical sidewalls 29 and tapered upper sidewalls 30. The vertical depth of the lower vertical sidewalls 29 of the isolator pad 25 is substantially the same as the depth of the bearing adaptor vertical isolator pad pocket 26, so that these pad lower sidewalls 29 are immediately adjacent to the pocket edges and are of the same height.

The height of the tapered isolator pad upper sidewalls 30 provides the clearance between the underside of the truck sideframe and the upper surface of the bearing adaptor 22. The resilient nature of the pad 25 provides the desired impact reduction. Maximum benefit is achieved by making the pad as large in the upper and lower surface area as can be accommodated between the underside of the truck sideframe and the upper surface of the bearing adaptor With presently in-use bearing adaptors, rectangular or square pads with dimensions between 4½ and 5 inches on a side are usable. The surface of the pad should be approximately 20 square inches in order to maintain the static compressive stress in the pad below 2,000 psi, although somewhat higher stress levels can be tolerated. The effective pad area should be 18 square inches as a minimum, preferably at least 20 square inches, and comfortably up to 25 square inches.

Of considerable importance is the fact that whatever the size and configuration of the lower surface of the pad, it should be such that it conforms closely to the size and shape of the bearing adaptor isolator pad pocket 26 in order that the isolator pad cannot slide around within the pocket and generate heat due to interface scrubbing friction. Accordingly, the alternative structure of FIG. 2*a* for the vertical isolator pad could also be used if for some reason a railroad considers it desirable that the pad have a steel base plate, although the preferred form is that shown in FIG. 2.

The pad of FIG. 2A is formed with a steel base plate 31, which would be substantially ⅛ inch in thickness, with the remaining overall height of the isolator pad 25A remaining the same as that of the pad 25, so that the thickness of the polymer portion will be reduced by ⅛ inch, basically in the vertical wall height portion 29A, while the tapered upper side wall 30A would be the same as the tapered side wall 30. The plate 31 must of course fit exactly within the bearing adaptor pocket 26 to prevent sliding friction from building up heat in the plate and ultimately causing a possible separation of the plate from the polymer pad. Any other means may of course be utilized in connection with the isolator pads which avoids relative sliding movement between the pad and the upper surface of the bearing adaptor, so long as such other means do not impair the structural integrity of the isolator pad. Moreover, the specific configuration of the pad is dictated by the size and configuration of the facing parts of the bearing adaptor and the truck sideframe and may be adapted to changes in such structures.

FIG. 3 shows the configuration of the vertical isolator pad which failed in service and which preceded the form of the preferred embodiment shown in FIG. 2. The tests previously described as being illustrated in FIGS. 5 through 11 to be hereinafter described, were carried out using the pad shown in FIG. 3. This pad was formed of a polymer pad 32 bonded to upper and lower one sixteenth inch thick steel plates 33 and 34. The polymer 32 is of lower durometer than the polymer of which the preferred embodiment of FIG. 2 is formed, and also has a lower melting point. However, the bonding of this polymer to the steel plates 33 and 34 effectively increased its stiffness. Tests of the form of isolator pad shown in the preferred embodiment of FIG. 2 with that of the form shown in FIG. 3 showed that the compressive spring rate stiffness of the two forms of pads are substantially the same, being within ten percent of one another so that the load/deflection performance of the two pads in pounds per inch is for all working purposes the same.

Before turning to the test data which led to the preferred form of the vertical isolator pad, attention should be directed to FIG. 4 which is an illustration of the Jones structure disclosed in U.S. pat. No. 3,381,629 and which was intended to eliminate lateral shocks to the sideframes resulting from hunting of the wheels, all as previously referred to. The Jones arrangement shows a bearing 35 surmounted by a bearing adaptor 36 which has seated thereon the Jones cushion formed from a steel base 37, a rubber pad 38 and an upper steel plate 39, which latter has the truck sideframe 40 seated upon it. These pads failed in use very quickly by extrusion of the rubber pad out from between the plates 37 and 39, and were abandoned many years ago.

The Jones pad failed for the same reasons as the form of isolator pad shown in FIG. 3 failed, but even more quickly because the rubber employed by Jones broke down faster than the polymer material utilized in the form of the pad shown in FIG. 3. What was unrecognized in both cases was the very high temperatures to which these pads are subjected in use due to frictional forces not recognized as being significant. The pad shown in FIG. 3 was a five eighth inch thick elastomer molded to a pair of sixteenth inch thick steel plates, one on each face. The steel plate had approximately one eighth inch clearance on each edge as the pad sat in the bearing adaptor pocket, and consequently was capable of some sliding movement within the pocket even under vertical load. The major significance that this would ultimately turn out to have was not appreciated.

Figure 6:
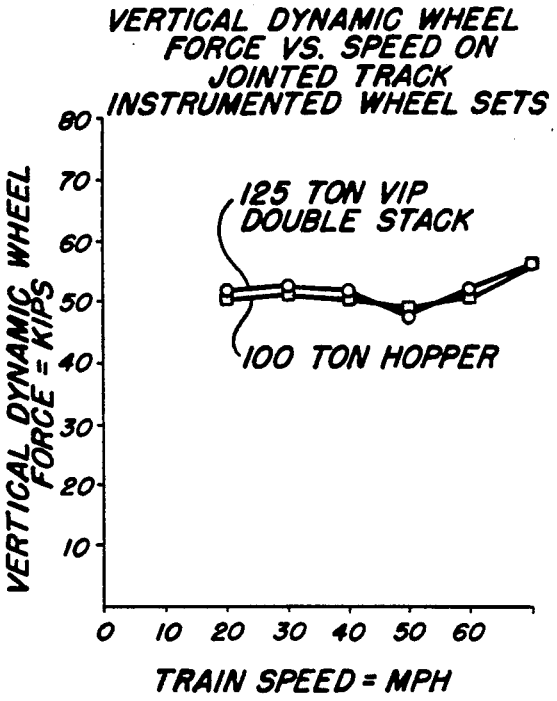

Considering now the drawings which show the data accumulated by the actual tests at the American Association of Railroads Test Center in Pueblo, Colo. FIGS. 5 and 6 show tests done respectively with instrumented track and with instrumented wheel sets on jointed railroad track which represents a typical staggered jointed rail found on most main line tracks. Test runs were conducted at each 10 mile per hour speed increment starting at 20 miles per hour and ending at 70 miles per hour. A series of runs at each speed was conducted to provide a sufficient database to identify force Values for each car type. The results of the two separate types of test indicated a very close relationship of vertical forces for both the 100 ton hopper car and the 125 ton double stack articulated wellcar with vertical isolator pads. The wellcars were loaded to 157,500 pounds and produced dynamic vertical forces similar to those produced by the 100 ton hopper cars loaded to 131,500 pounds. The difference in loading produced substantially no difference in the vertical impact forces. This is more noticeable when compared with the 125 ton hopper car in FIG. 5 which shows considerably higher impact forces.

Figure 7:
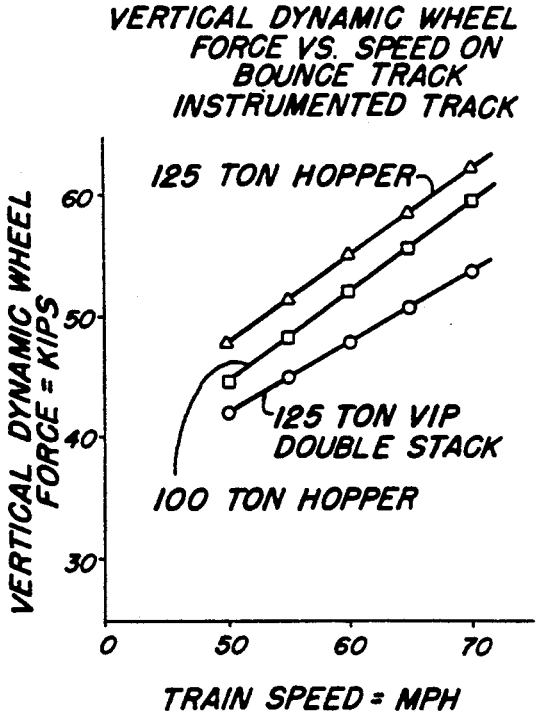
Figure 8:
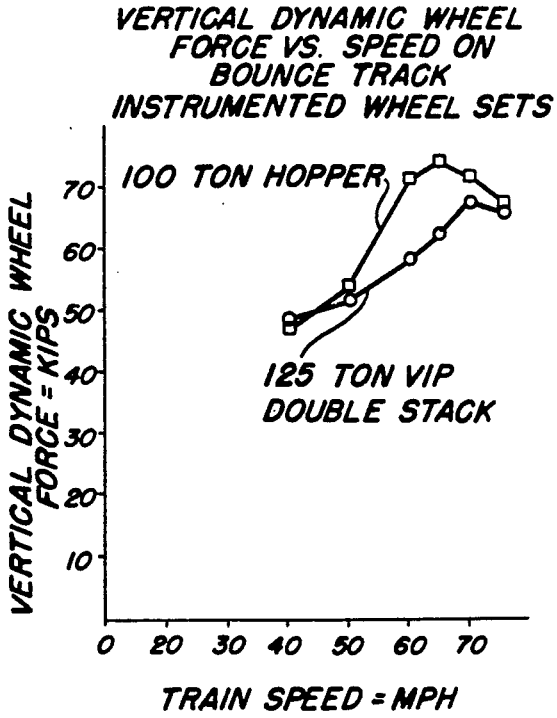

The same basic results are shown in FIGS. 7 and 8 for these same cars tested on bounce track, which is a parallel rail joint condition with a three quarter inch vertical amplitude for ten cycles on 39 foot centers. These tests were conducted at speeds ranging from 50 miles per hour to 70 miles per hour with an attempt to run at the bounce resonance speed for both of the cars whose test data is shown in FIG. 8. This type of roadbed condition is freguently seen at road crossings and bridge approaches, and can produce high vertical carbody acceleration. The 125 ton hopper car showed increasing force values with evidence that the vertical bounce resonance was at a speed higher than 70 miles per hour. The 100 ton hopper car exhibited strong vertical bounce resonance between 60 and 65 miles per hour, and in all tests, the 125 ton double stack car with vertical isolator pads exhibited lower vertical forces at the wheels than did the 100 ton hopper car without vertical isolator pads.

Figure 9:
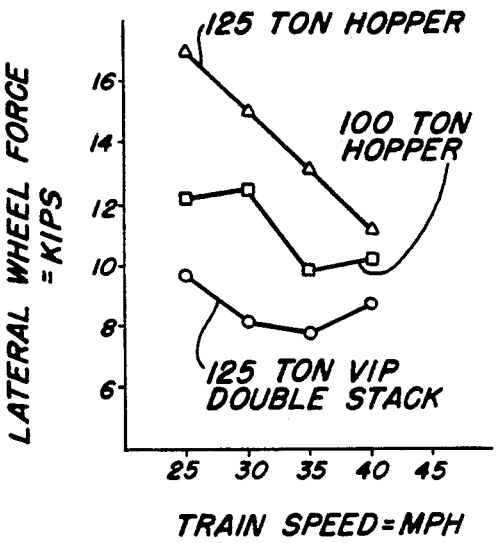
Figure 10:
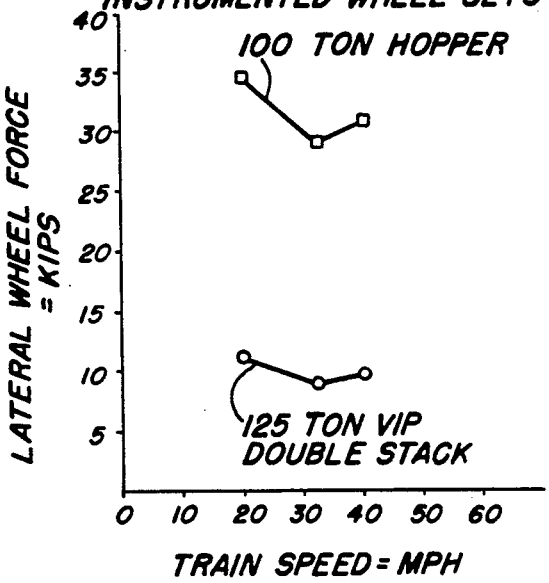
Figure 11:
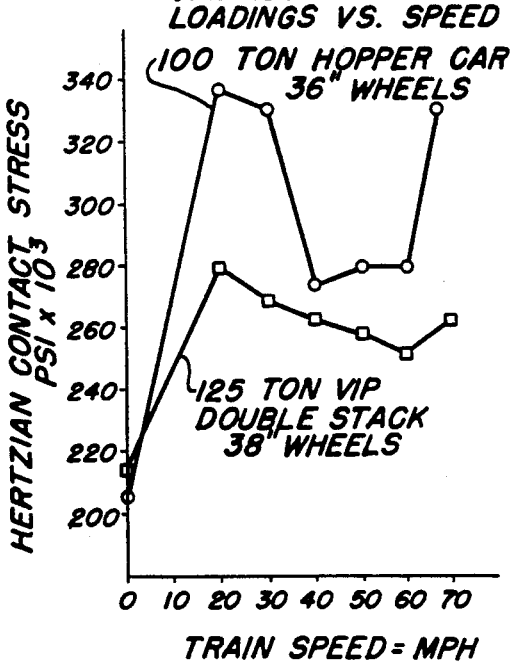

FIGS. 9 and 10 illustrate the data for the tests run on the balloon loop track which simulates lateral forces developed under track conditions having severe horizontal curves which may be sensitive to rail overturning or rail shifting. The balloon track is a continuous 7.5° horizontal curve having about 4½ inches of super elevation. The test were conducted from 20 miles per hour to 45 miles per hour with the balance speed being approximately at 30 miles per hour. FIG. 9 shows a range of lateral wheel forces from 7,000 to 9,000 pounds on the 125 ton vertical isolator pad double stack car compared to a range of 10,000 to 13,000 pounds on the 100 ton hopper car with the 125 ton hopper car being even higher. FIG. 10 data taken with instrumented wheel sets shows that the lateral forces on the 100 ton hopper car wheels are much higher than when measured with the instrumented track, and that the forces on the wheels of the 125 ton vertical isolator pad double stack car was significantly lower than either of the other cars without the isolator pads.

One of the most important factors to be considered in rail wear is the Hertzian contact stress. Simply stated, accelerated wear is directly proportional to increased contact stresses. The contact stresses are a function of the vertical load and the size of the contact patch, which is generally an ellipse. The contact patch size varies with diameter of the wheel and the radius of the railhead in the area where the wheel and rail meet. A worst case condition is with a new wheel and a new rail where the contact patch is at a minimum. As the wheel and rail wear through normal service the contact patch tends to grow, with corresponding reductions in Hertzian contact stresses. This phenomenon has been borne out in practice since the highest wear rates for both wheels and rail tend to occur when they are new.

Analysis has shown that for the condition of static 100 ton loadings (33 KIP wheel loads) with 36 inch wheels versus 125 ton loadings (39 KIP wheel loads) with 38 inch wheels, the increase in Hertzian contact stresses is only about 4% when used with either 10 inch or 14 inch head radius rail. When operating at speed the reduced dynamic amplification resulting from a vertical isolator pad equipped railroad car truck reduces the dynamic wheel force levels more than the 4% static stress increase, resulting in static values of Hertzian contact stresses less than those for 100 ton trucks. The result is that a vertical isolator pad equipped 125 ton truck will actually produce less wheel and rail wear than a standard 100 ton truck without the isolator pads, as shown by the test data in the graph of FIG. 11.

In summation of the test data presented in FIGS. 5 through 11, it is clear that the 125 ton double stack wellcars equipped with vertical isolator pads and the 100 ton hopper cars without vertical isolator pads produced nearly equivalent vertical dynamic forces within the speed range of the test conducted on jointed rail. On the vertical bounce rail the 125 ton double stack wellcar with vertical isolator pads consistently generated dynamic vertical forces that were lower than either the 100 ton or 125 ton hopper cars. These tests generated the highest vertical "g" forces on the rails with spring bottoming occurring on the hopper cars, and suggest that the vertical isolator pads when applied to the hopper cars could prevent such spring bottoming. Again, with the balloon track rail tests the 125 ton double stack wellcars with vertical isolator pads consistently produced lower lateral forces on the wheels than the 100 ton and 125 ton hopper cars.

Figure 14:
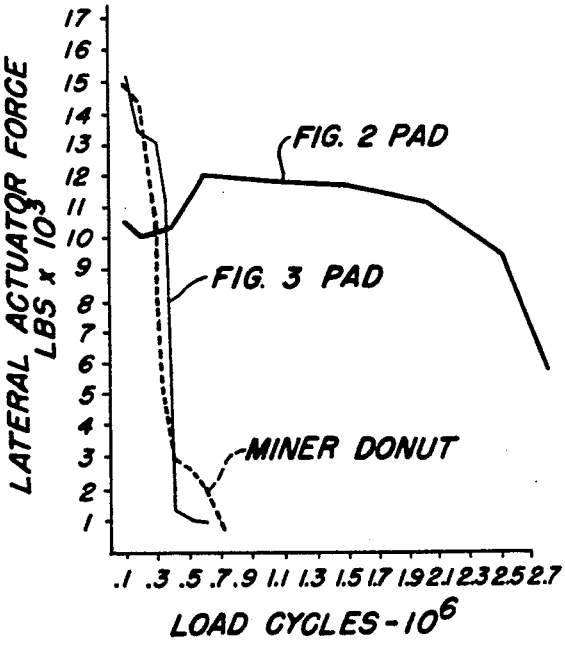
FIG. 14 is a graph of comparative test data obtained from tests of the pads shown in FIGS. 2 and 3 and another pad not illustrated, when tested in the apparatus shown in FIGS. 12 and 13.
Figure 12:
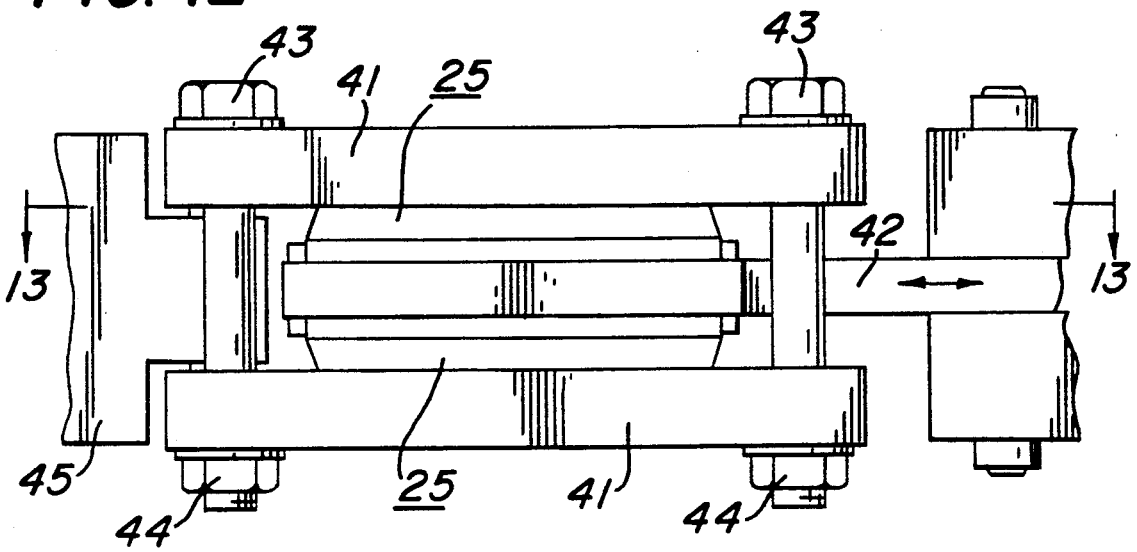
FIGS. 12 and 13 are side and sectional views of a vibratory testing device for the isolator pads.
Figure 13:
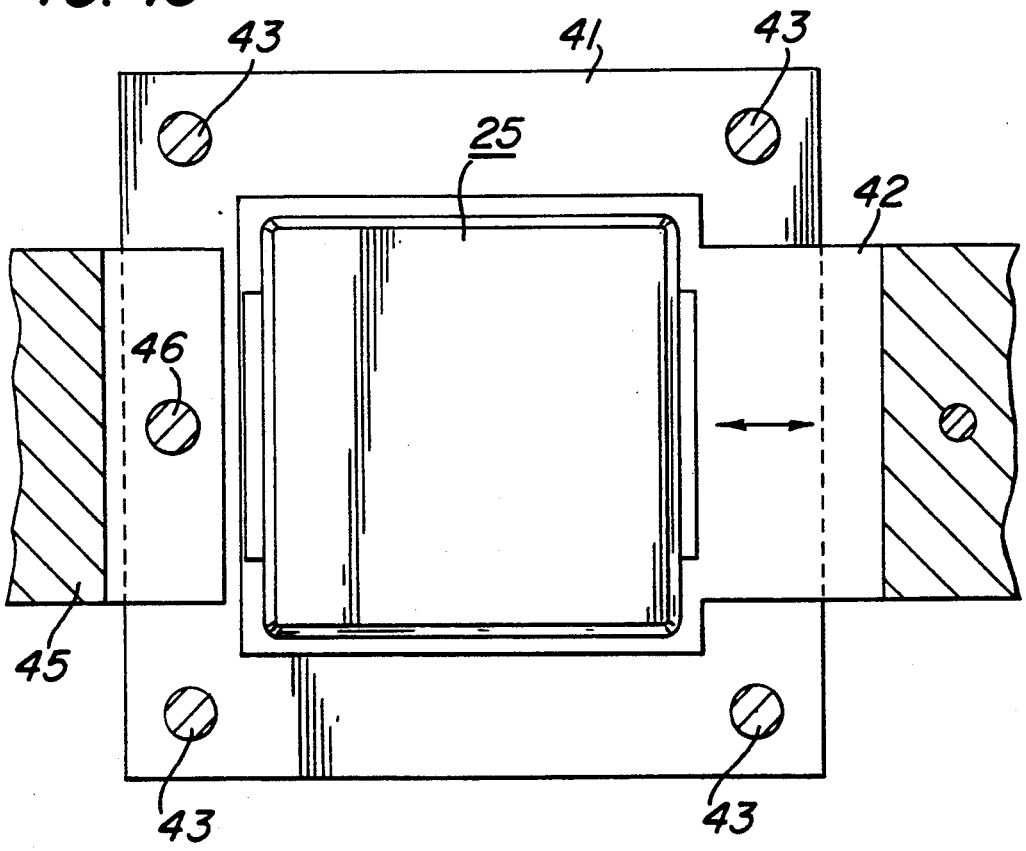

The critical comparative data shown in FIG. 14 was obtained by testing the various pads in the test jig apparatus shown in FIGS. 12 and 13, to which attention should now be directed. FIGS. 12 and 13 show a test jig in which two vertical isolator pads 25 are shown clamped between a pair of outer plates 41 and an inner plate 42. The bolts 43 and nuts 44 were tightened to exert 40,000 pounds of compressive load on the pads. One end of the jig was anchored by means of the clevis 45 and bolt 46, while the inner plate 42 was oscillated plus or minus one eighth of an inch at six Hertz until failure of the pads occurred. This test provides not only a static compressive load but a shearing load at right angles to the static load. Failure was determined by observing the force on the cycling plate 42 as the test progressed, beginning with the force at the very start of the test. While the pads were functioning properly this force was measurable on the order of between 10,000 and 15,000 pounds. However, when failure occurred there was a dramatic decrease in the measurable force, to on the order of 1,000 pounds.

Three pad types were tested, namely the pads shown in FIGS. 2 and 3 of the drawings, and another doughnut or toroidal shaped pad manufactured by Miner Enterprises, Inc. of Geneva, Ill., the material of which this latter pad was fabricated not being known. The purpose of the tests on these pads was to determine whether or not the types of failures which had occurred in the field could be simulated, and indeed when these pads had failed and been removed from the testing apparatus visual observation showed that they looked substantially identical to pads which had failed in the field, indicating that the forces generated in the test jig of FIGS. 12 and 13 were very similar to the forces generated in the pads in use. During the test procedure temperatures were monitored with thermocouples at the edges of the tested pads, and it was determined that temperatures in excess of 300° Fahrenheit were present. As shown in FIG. 14, the testing showed that the pads started to show some sign of deterioration between 300,000 and 400,000 cycles, and that by the time 600,000 cycles had been achieved, the pads of the type shown in FIG. 3 of the drawings and the Miner pads had all failed. Based upon field failure data it appeared that 15 months was about the average time these pads failed, and corresponded to approximately 500,000 cycles in the testing scheme, representing about 300,000 miles of service.

In view of the fact that the test pads showed the same kinds of failures as the pads in actual use, it was reasonable to assume that the testing procedure was proper for simulating field use. Accordingly, the isolator pads according to the invention, as shown in FIG. 2, were also tested in exactly the same way, with the result that these pads did not show any evidence of failure until a minimum of two million cycles had been achieved. After two million cycles the measured force level on the steel plate 42 began to drop, but its drop was not precipitous as in the case of the failures of the other types of pads. The force started to drop off gradually until at about two and a half million cycles it began to drop more steeply, but nevertheless still in a controllable way, so that even at three million cycles the measured force was still substantially 4,000 pounds. Examination of the isolator pads according to the invention after three million cycles showed that they were still in relatively good condition with some slight edge damage. Translating this data into actual double stack railroad wellcar usage time, based upon railroad data the three million cycle testing of the isolator pad according to the invention shows that these pads will give service for one million miles or approximately three to five years of actual car usage. At this time it is projected that the railroads would bring such cars in for complete reservice, so that the isolator pads according to the invention meet the requirements of the railroad industry.

Performance comparison between the old failed pad type shown in FIG. 3 when it was in proper operating condition, and the pad of FIG. 2 according to the invention, disclosed that they performed substantially identically in terms of their improved load carrying capability. The compressive stiffness of the two different pads is achieved in different ways. With the pads according to the invention the compressive stiffness is that of the elastomer itself, whereas with the pad as shown in FIG. 3, the stiffness of the elastomer was effectively increased by the bonding to the steel plates. The elastomer of the original pads if it were suitable for use without the steel plates would not provide the stiffness required, whereas the new material when bonded to steel plates would become so stiff as effectively to provide no isolation whatever between the railroad car truck and the car body.

Having now described the invention in connection with particularly illustrated embodiments thereof, it is to be understood that modifications and variations of the invention may now naturally occur from time to time to those persons normally skilled in the art without departing from the essential scope or spirit of the invention, and accordingly it is intended to claim the same broadly as well as specifically as indicated by the appended claims.

I claim:

1. For use with railroad cars having trucks which include sideframes and which also include roller bearing adaptors, an elastomeric vertical isolator pad for placement between the roller bearing adaptors of a railroad car and the car truck sideframes, said pad being configured to have a base surface, an upper surface and sidewall portions, said base surface being adapted for fixed positioning with respect to the top of the bearing adaptor, said sidewall portions extending upward beyond the upper surface of the bearing adaptor to said pad upper surface, which latter is configured for surface engagement with an overlying part of the truck sideframe, said elastomer having a melting point not lower than 500° Fahrenheit.

2. An isolator pad as set forth in claim 1 wherein said elastomer is characterized by a Shore hardness durometer in the range of 50 to 70.

3. An isolator pad as set forth in claim 1 wherein said elastomer is characterized by a Shore hardness durometer of 65.

4. An isolator pad as set forth in claim 1 wherein the base surface of said pad is between 18 and 25 square inches.

5. An isolator pad as set forth in claim 1 wherein said pad base surface comprises a steel plate bonded to the lower surface of said elastomer pad.

6. An isolator pad as set forth in claim 1 wherein said elastomer pad comprises a TDI-polyether aminecured urethane.

7. For use with railroad cars having trucks and roller bearing adaptors in which the trucks include sideframes and the tops of the roller bearing adaptors are formed with a pocket, an elastomeric vertical isolator pad for placement between the roller bearing adaptors of a railroad car and the car truck sideframes, said pad being configured to have a base surface, an upper surface and upper and lower sidewall portions, said base surface and lower sidewall portions being sized to fit snugly within the pocket on the top of the bearing adaptor to prevent shifting of said pad within the pocket, said upper sidewalls portions of said pad extending upward beyond the upper surface of the bearing adaptor and being angled inwardly to said pad upper surface, which latter is configured for surface engagement with an overlying part of the truck sideframe.

8. An isolator pad as set forth in claim 7, wherein said elastomer has a melting point not lower than 500° Fahrenheit.

9. An isolator pad as set forth in claim 7 wherein said elastomer is characterized by a Shore hardness durometer in the range of 50 to 70.

10. An isolator pad as set forth in claim 7 wherein said elastomer is characterized by a Shore hardness durometer of 65.

11. An isolator pad as set forth in claim 7 wherein said pad lower sidewalls do not extend above the upper edges of the bearing adapter pocket sides to an extent which under compression can cause said pad lower sidewalls to bulge and contactingly overlie any part of the upper surface of the bearing adaptor.

12. An isolator pad as set forth in claim 7 wherein said elastomeric pad comprises a TDI-polyether aminecured urethane.

13. For use with railroad cars having trucks and roller bearing adaptors in which the trucks include sideframes and the tops of the roller bearing adaptors are formed with a pocket, an elastomeric vertical isolator pad for placement between the roller bearing adaptors of a railroad car and the car truck sideframes, said pad being formed of an elastomer having a melting point not lower than 500° Fahrenheit and having a Shore hardness durometer in the range of 50 to 70, said pad being configured to have a base surface, an upper surface, and upper and lower sidewall portions, said base surface and lower sidewall portions being sized to fit snugly within the pocket on the top of the bearing adaptor to prevent shifting of said pad within the pocket, said upper sidewalls portions of said pad extending upward beyond the upper surface of the bearing adaptor to said pad upper surface, which latter is configured for surface engagement with an overlying part of the truck sideframe, said pad upper sidewall portions being angled inwardly from the upper edges of said pad lower sidewall portions to said pad upper surface.

14. An isolator pad as set forth in claim 13 wherein the base surface of said pad is between 18 and 25 square inches.

15. An isolator pad as set forth in claim 13 wherein said pad base surface comprises a steel plate bonded to the lower surface of said elastomeric pad.

16. An isolator pad as set forth in claim 13 wherein said elastomeric pad comprises a TDI-polyether aminecured urethane.

17. An isolator pad as set forth in claim 13 wherein said pad lower sidewalls do not extend above the upper edges of the bearing adapter pocket sides to an extent which under compression can cause said pad lower sidewalls to bulge and contactingly overlie any part of the upper surface of the bearing adaptor.

* * * * *